US006866397B2

(12) United States Patent
Cheng et al.

(10) Patent No.: US 6,866,397 B2
(45) Date of Patent: Mar. 15, 2005

(54) LEADING WIRE ARRANGEMENT OF A LIGHTING FIXTURE IN A BACK LIGHT MODULE

(75) Inventors: Wen-Yuan Cheng, Taoyuan Hsien (TW); Chi-Chih Chu, Taipei Hsien (TW)

(73) Assignee: AU Optronics Corporation, Hsinchu (TW)

( * ) Notice: Subject to any disclaimer, the term of this patent is extended or adjusted under 35 U.S.C. 154(b) by 0 days.

(21) Appl. No.: 10/349,927

(22) Filed: Jan. 24, 2003

(65) Prior Publication Data

US 2003/0165057 A1 Sep. 4, 2003

(30) Foreign Application Priority Data

Mar. 1, 2002 (TW) ..... 91103726 A

(51) Int. Cl.[7] ..... H01R 33/00

(52) U.S. Cl. ..... 362/226; 362/31; 349/58; 439/718

(58) Field of Search ..... 439/718; 349/58, 349/61, 62, 63, 34, 65; 362/26, 31, 226, 27; 359/28, 49, 50

(56) References Cited

U.S. PATENT DOCUMENTS

| | | | | | |
|---|---|---|---|---|---|
| 4,639,842 | A | * | 1/1987 | Upchurch | 362/376 |
| 5,280,372 | A | * | 1/1994 | Horiuchi | 349/65 |
| 5,420,710 | A | * | 5/1995 | Nanbu | 349/62 |
| 5,537,296 | A | * | 7/1996 | Kimura et al. | 362/31 |
| 6,386,722 | B2 | * | 5/2002 | Okumura | 362/31 |
| 6,667,779 | B2 | * | 12/2003 | Lee | 349/58 |
| 6,667,780 | B2 | * | 12/2003 | Cho | 349/58 |

* cited by examiner

*Primary Examiner*—John Anthony Ward
(74) *Attorney, Agent, or Firm*—Troxell Law Office, PLLC

(57) ABSTRACT

A leading wire arrangement in a lighting fixture with back light module provides a set of connecting wire led from the lighting fixture to a rear side of the back light module via a lateral wall of the back light module.

2 Claims, 2 Drawing Sheets

LEADING WIRE ARRANGEMENT OF A LIGHTING FIXTURE IN A BACK LIGHT MODULE

BACKGROUND OF THE INVENTION

1. Field of the Invention

The present invention relates to a leading wire arrangement of a lighting fixture in a back light module.

2. Description of Related Art

The liquid crystal display (LCD) is popularly adopted in electronic or information industry and the principle of the LCD is in that a back light module is installed in the LCD and the back light module includes a back light plate and a lighting fixture or a light source, which usually is a light tube, to display luminously. The back light module is attached to a PDA, a notebook computer, a VCD, a DVD or any other image display.

Accordingly, the lighting fixture of the back light module basically has to be used with an external power source. Hence, connecting wires have to be led out after the lighting fixture being mounted to the back light module while the back light module is made. Further, a terminal has to be prepared in advance for being possible to take the electricity during the back light module being in use.

A conventional leading wire of the lighting fixture in the back light module is as shown in FIG. 1 and the corner of the back light module A extends a connector B. The connector B with the connecting wires C and a lighting fixture, i.e., a light tube are lined up so that the soldered spots between the connector B and the connecting wires C may become loose in case of the connector B being pulled with a linear drag force. If the drag force is over vigorously pulled, it is possible to break the connecting wires C. Besides, as the forgoing, the back light module A has to be mounted on an another product such as a notebook computer so that the frame part of the notebook computer has to be restricted by the connector B and the connecting wires extending from the lateral side of back light module A and both the design and layout of the subsequent product are affected unfavorably.

SUMMARY OF THE INVENTION

The crux of present invention is to provide a leading wire arrangement of a lighting fixture in a back light module, which provides a set of connecting wires led from the lighting fixture to a rear side of the back light module via a lateral wall of the back light module.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENTS

Figure 1:
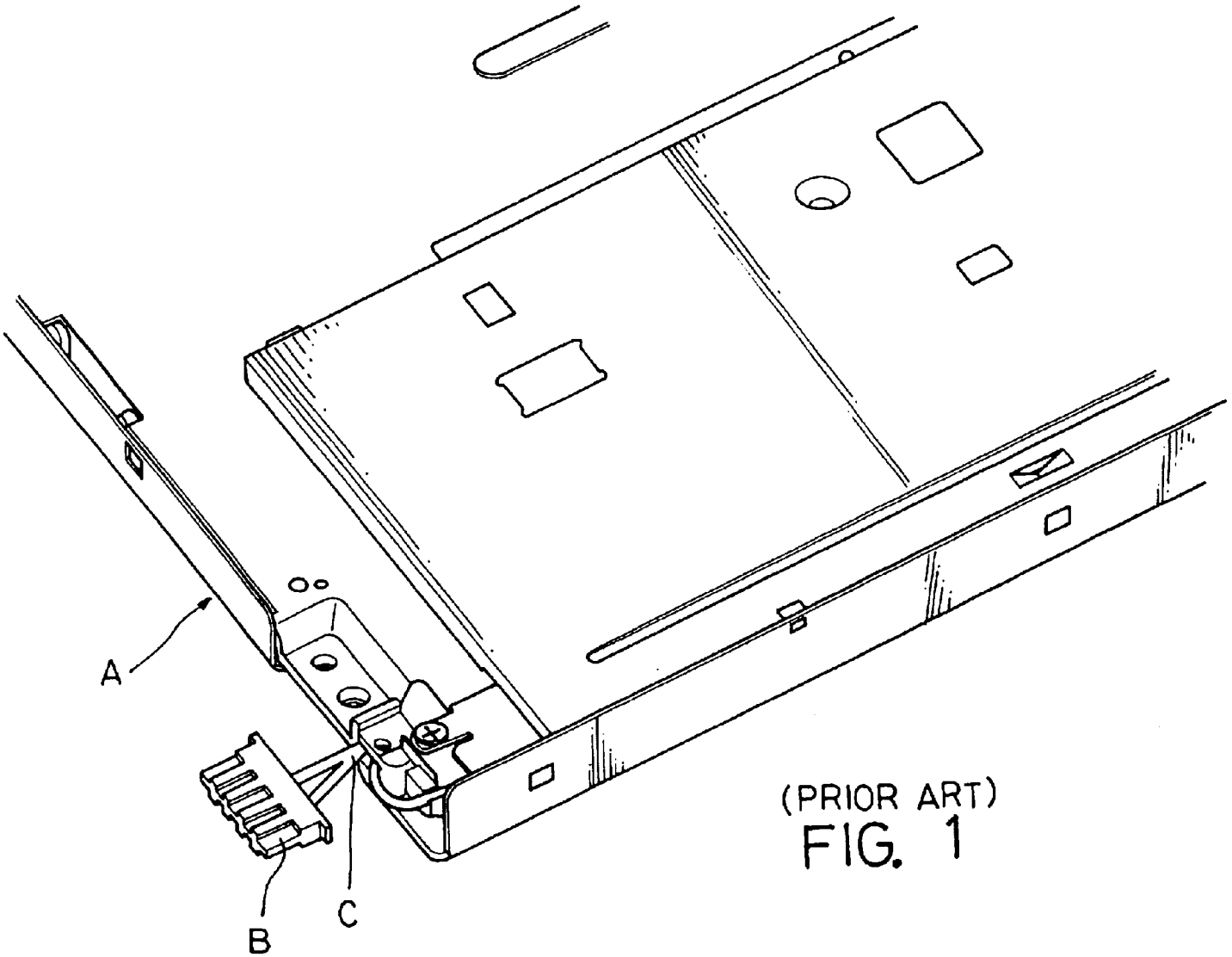
(PRIOR ART) FIG. 1
FIG. 1 is a perspective view illustrating a conventional way of the electrical wires of a lighting fixture in a back light module being lead out.
Figure 2:
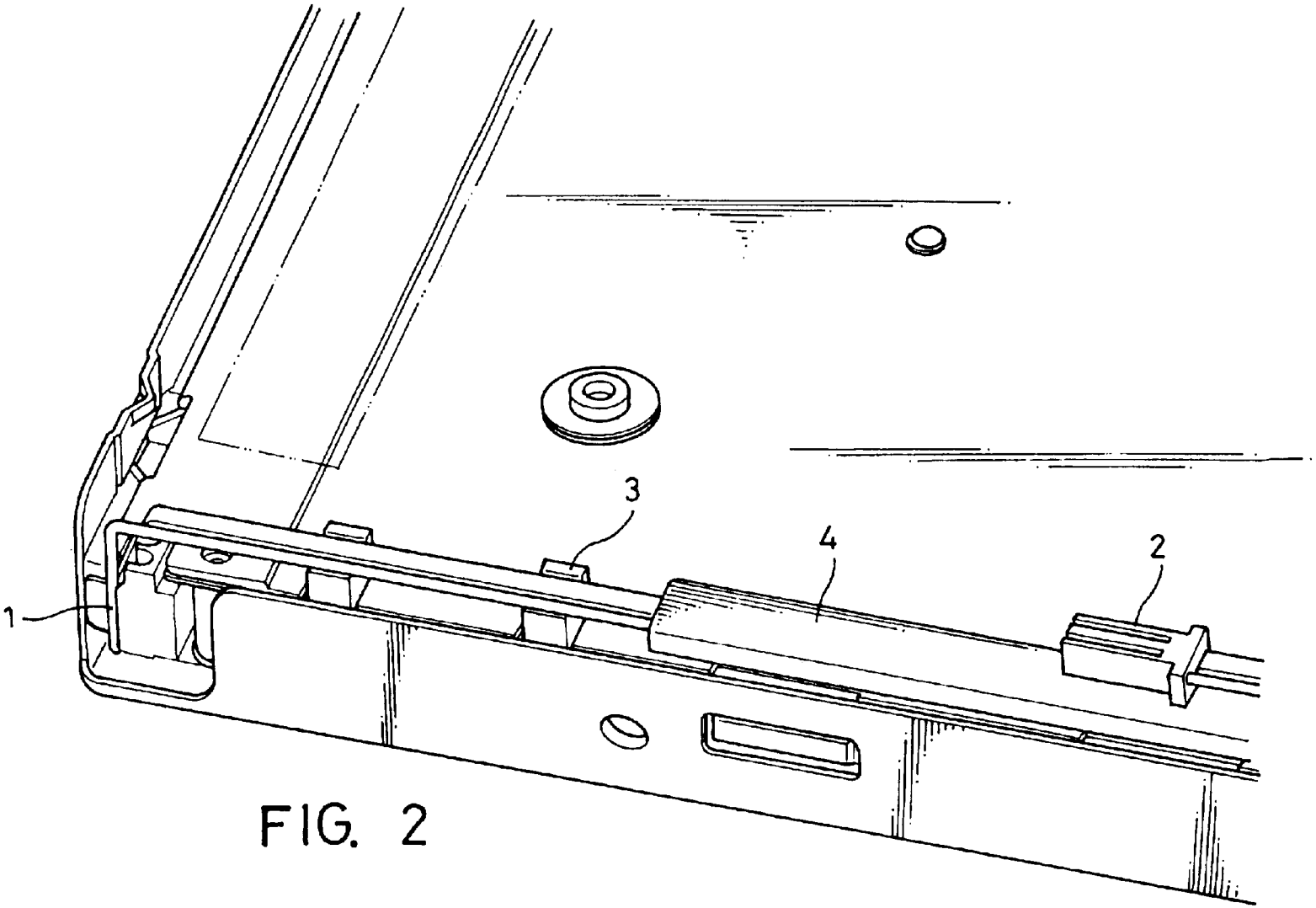
FIG. 2 is a perspective view illustrating the electrical wires of a lighting fixture in a back light module according to the present invention being lead out.

Referring to FIG. 2, basically, a wire leading arrangement of a lighting fixture in a back light according to the present invention comprises a set of connecting wires 1, a connector 2, at least a grip base 3 and and/or a heat shrunken jacket 4.

Wherein, the connecting wires 1 are associated with a lighting fixture (not shown) and at the end part thereof is connected to the connector 2. It can be seen that the connecting wires 1 are led from a corner of a back light module and then bypass the edge part thereof, i.e., the lateral wall thereof. Finally, the connecting wires 1 further extend along the back of the module so as to be disposed on the back of the module via a turn.

The connector 2 is disposed at the end part of the connecting wires 1 for being inserted with the external power source. It is noted that the connector 2 is belonged to the prior art and no detail will be described further.

The grip base 3 is provided on the frame of the module for holding the connecting wires 2 and slightly stretching the connecting wires 2. In case of the connector being pulled, the grip base 3 can mitigate the pulling force moderately so as not to drag violently the connecting wires 1 at a section part thereof next to the end of lighting fixture.

The heat-shrunken jacket 4 is covering tube enclosing the connecting wire 1. Because the heat-shrunken jacket 4 is also belonged to the prior art, no detail will be described further.

Referring to FIG. 2 again, the power source of the lighting fixture can be obtained via the connector 2 of the back light module and the corner of the wall edge is not attached with a section of wires and a connector while the lighting fixture is continuously used so that the design of the lighting fixture becomes much more flexible due to no jutting out part. Meanwhile, once the connector 2 is pulled with a drag force, it is not easy for the soldered conjunction of the connecting wires 1 and lighting fixture to become separate so that the undesirable phenomenon with regard to the connecting wires being detached from the soldered junction can be eliminated effectively.

While the invention has been described with reference to a preferred embodiment thereof, it is to be understood that modifications or variations may be easily made without departing from the spirit of this invention, which is defined by the appended claims.

What is claimed is:

1. A leading wire arrangement for a back light module of an LCD lighting fixture comprising:

a) a set of connecting wires extending from the back light module and having a connector;

b) a grip base located along an edge of a backside at an exterior of the back light module, the set of connecting wires being inserted into the grip base, the grip base directly engaging an exterior of the set of connecting wires; and c) a heat shrunken jacket covering a portion of the set of connecting wires and located between the grip base and the connector, the heat shrunken jacket being spaced apart from the grip base.

2. A leading wire arrangement for a back light module of an LCD lighting fixture comprising:

a) a set of connecting wires extending from the back light module and having a connector;

b) a grip base located along a lateral side of an exterior of the back light module, the set of connecting wires being inserted into the grip base, the grip base directly engaging an exterior of the set of connecting wires; and c) a heat shrunken jacket covering a portion of the set of connecting wires and located between the grip base and the connector, the heat shrunken jacket being spaced apart from the grip base.

* * * * *